US010533434B2

(12) United States Patent
Frauca et al.

(10) Patent No.: US 10,533,434 B2
(45) Date of Patent: Jan. 14, 2020

(54) DISMANTLING DEVICE FOR BLADES AND CORRESPONDING DISMANTLING METHOD

(71) Applicant: SAFRAN AIRCRAFT ENGINES, Paris (FR)

(72) Inventors: Jean Marie Frauca, Moissy Cramayel (FR); Yann Merschaert, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 347 days.

(21) Appl. No.: 14/905,118

(22) PCT Filed: Jul. 10, 2014

(86) PCT No.: PCT/FR2014/051774
§ 371 (c)(1),
(2) Date: Jan. 14, 2016

(87) PCT Pub. No.: WO2015/007979
PCT Pub. Date: Jan. 22, 2015

(65) Prior Publication Data

US 2016/0169010 A1 Jun. 16, 2016

(30) Foreign Application Priority Data

Jul. 15, 2013 (FR) ..... 13 56940

(51) Int. Cl.
*F01D 5/30* (2006.01)
*F01D 25/28* (2006.01)
(Continued)

(52) U.S. Cl.
CPC ..... *F01D 5/30* (2013.01); *F01D 5/02* (2013.01); *F01D 5/12* (2013.01); *F01D 5/3007* (2013.01);
(Continued)

(58) Field of Classification Search
CPC ..... F01D 5/30; F01D 5/02; F01D 5/12; F01D 5/307; F01D 25/285; F05D 2240/60;
(Continued)

(56) References Cited

U.S. PATENT DOCUMENTS 5,737,816 A * 4/1998 Hartmann ..... F01D 5/3007 29/23.51

FOREIGN PATENT DOCUMENTS

| | | |
|---|---|---|
| EP | 0 745 756 A1 | 12/1996 |
| EP | 2 083 146 A2 | 7/2009 |
| EP | 2 354 456 A2 | 8/2011 |

OTHER PUBLICATIONS

International Search Report as issued in International Patent Application No. PCT/FR2014/051774, dated Oct. 21, 2014.

* cited by examiner

*Primary Examiner* — Moshe Wilensky
(74) *Attorney, Agent, or Firm* — Pillsbury Winthrop Shaw Pittman LLP

(57) ABSTRACT

A device for dismantling a blade from a turbine, the turbine including a set of blades, the device including: a holding element including a blocking surface; a dismantling opening; an attachment system configured to attach the holding element to a shaft of the turbine, the attachment system producing a pivot connection between the holding element and the shaft of the turbine, the defining of an angular position of the holding element allowing a first function of dismantling at least one blade facing the dismantling opening to be carried out and allowing a second function of blocking a set of blades facing the blocking surface to be carried out.

7 Claims, 5 Drawing Sheets

(51) Int. Cl.
*F01D 5/02* (2006.01)
*F01D 5/12* (2006.01)

(52) U.S. Cl.
CPC ..... *F01D 25/285* (2013.01); *F05D 2220/30* (2013.01); *F05D 2230/60* (2013.01); *F05D 2230/70* (2013.01); *F05D 2240/60* (2013.01); *F05D 2260/30* (2013.01)

(58) Field of Classification Search
CPC ..... F05D 2220/30; F05D 2260/30; F05D 2230/60; F05D 2230/70
See application file for complete search history.

DISMANTLING DEVICE FOR BLADES AND CORRESPONDING DISMANTLING METHOD

CROSS-REFERENCE TO RELATED APPLICATIONS

This is the U.S. National Stage of PCT/FR2014/051774, filed Jul. 10, 2014, which in turn claims priority to French Patent Application No. 1356940, filed Jul. 15, 2013, the entire contents of all applications are incorporated herein by reference in their entireties.

TECHNICAL FIELD OF THE INVENTION

The invention relates to a device for dismantling at least one blade from a turbine; to a system for dismantling at least one blade from a turbine, to a method for mounting such a device for dismantling and also to a method for dismantling at least one turbine blade.

The invention relates more particularly to the field of turbines of aircraft engines, and in particular high pressure turbines.

PRIOR ART

FIG. 1 diagrammatically shows a general cross section of an aircraft engine and the various portions of said engine. The air entering by the air intake of the ADMISSION portion of the cold section is compressed in a compressor (COMPRESSION portion in FIG. 1) before being mixed with a fuel and burned in one of the combustion chambers of the COMBUSTION portion. The hot gases produced in the combustion chamber reach the blades of the turbine and drive the turbine (or several turbines) then are ejected on the EXHAUST portion of the engine which generates a thrust that drives the aircraft. A turbine stage is generally constituted of a fixed blading followed by a mobile blading. A turbine can comprise one or several stages. The invention relates more particularly to the dismantling of the mobile blading from the turbine.

Maintenance operations are carried out on these aircraft engines when the engine is horizontal to its turbine, contrary to the initial assembly operations which are generally carried out vertically. As such the dismantling of the blades from the HP turbine is generally carried out in situ, i.e. when the engine remains horizontal to its turbine.

As the axis of insertion of the blades into the cells of the turbine wherein they are received is inclined with respect to the engine axis so as to contribute to the maintaining of the blades between them during the rotation at high speed of the turbine, the dismantling of the blades is carried out progressively and radially in an ellipse. The inclination of the axis of insertion of the blades with respect to the engine axis can be about thirty degrees for example. FIG. 2 makes it possible to view the inclination of an angle of the axis of insertion Xi of a blade A with respect to the shaft of the turbine Ar (shaft of the turbine and engine axis are confounded).

The dismantling of the blades, just as the installation, is carried out progressively due to the geometry of the blade roots (due to the inclination with respect to the engine axis mentioned hereinabove) and of the very low clearance, even practically inexistent between the blades. A seal sleeve is furthermore generally inserted between two successive blades in order to reduce the clearance between the blades to practically zero. The removal is carried out progressively, i.e. blade after blade, a short distance by short distance until each blade is maintained only by a few millimetres in the cell wherein its root is inserted. These few millimetres, for example two millimetres, make it possible to have a sufficient clearance between the blades to be able to extract them one by one.

During their progressive removal, a moment arrives when all of the blades are maintained by only a few millimetres in their respective cells. This moment is critical due to the horizontal position of the turbine. Indeed, as the blades are retained in their respective cells by only a few millimetres, the final dismantling which consists in completely extracting one after the other each one of the blades from their respective cell (or a single blade if a single blade has to be dismantled) must take place quickly and with sufficient safety as to maintain the integrity of the equipment. Note that generally turbines comprise several tens of blades and one or even two people maximum participate in the dismantling operation. It is therefore not possible for one person to maintain all of the blades at the same time.

In the event of a false manoeuvre, impact, vibration, for example, a portion of the blades risks falling and becoming deteriorated or impacting and damaging other parts of the engine such as the trunnion close to the blades. The slightest deterioration in this type of part requires that it be changed which consequently generates substantial costs.

DISCLOSURE OF THE INVENTION

The invention aims to overcome all or a portion of the disadvantages of prior art identified hereinabove, and in particular to propose means for making it possible to secure the dismantling of the blades by limiting as much as possible the risk of blades falling during the operation in horizontal position of the engine.

To this end, an aspect of the invention relates to a device for dismantling at least one blade from a turbine, said turbine comprising a set of blades, said device comprising:

a holding element comprising:

a blocking surface;

a dismantling opening;

means of attaching the holding element to a shaft of the turbine, the attachment means producing a pivot connection between the holding element and the shaft of the turbine, the defining of an angular position of the holding element allowing a first function of dismantling at least one blade facing the dismantling opening and allowing a second function of blocking a set of blades facing the blocking surface.

Such a device advantageously makes it possible to block, preferentially axially, i.e. according to a direction parallel to the shaft of the turbine, the blades of the turbine when the latter are retained in their respective cells only by a few millimetres i.e. when they are ready to be dismantled. As such during the dismantling in situ, when the engine is horizontal to its turbine, there is no longer any risk for a turbine blade to fall just before the dismantling itself (removal of the blade from its cell).

As such a single operator, can work on the turbine and clear partially, gradually and in ellipse each one of the blades without having to hold them manually when they are retained only by a few millimetres in their respective cells. The blocking surface prevents the blades from falling.

The dismantling opening can, be a notch made in the holding element. The dimensioning of the dismantling opening is linked to the height of the portion of the blade taken in its cell so as to provide for its extraction from said cell. The dismantling opening makes it possible to overcome the unknowns that are proper to the environment where the dismantling takes place of the blade of the type horizontal position of the engine or module, risk of contact between operators and therefore of the falling of one or several blades, small repeated impacts or forces in order to remove each blade from its housing, possible instability of the ground, impacts on the engine.

The holding element is preferentially attached to the hub/trunnion of the turbine.

The defining of an angular position of the holding element can be done by rotating the holding element manually about the shaft of the turbine due to the pivot connection. As such when all of the blades are retained only by a few millimetres in their respective cells and the clearance between two blades is sufficient for the dismantling of a blade, placing the dismantling opening facing the blade to be dismantled allows an operator to access this blade which is not blocked by the blocking surface. The other blades are maintained thanks to the blocking surface and do not risk falling in the event of a jolt, false manoeuvre or other accident.

In addition to the main characteristics that have just been mentioned in the preceding paragraph, the device according to the invention can have one or several of the following additional characteristics, considered individually or according to any technically permissible combinations:

the dismantling opening is at the periphery of the holding element. As the blade is located at the periphery of the turbine, the dismantling opening is as such preferentially located to the right of the root of the blade to be extracted and of the portion of the holding element serving as a holding abutment, i.e. the blocking surface;

the holding element comprises at least one access opening allowing an operator to access a zone of the space defined facing the blocking surface. The holding element can comprise a plurality of access openings distributed on the holding element. They allow an operator to manually access the turbine blades so as to facilitate their extraction from the cells;

the holding element is a ring;

the attachment means comprise a first ring, a second ring, with the superposition of the first and second rings forming a circular groove for the maintaining of the holding element and for the driving in rotation of the holding element with respect to the shaft of the turbine. The holding element is as such sandwiched between the first and second rings in the circular groove formed as such and which participates both in maintaining it and in carrying out the pivot connection between the holding element and the shaft of the turbine. To do this, the first ring can be made integral in rotation with the shaft of the turbine and the second ring be attached to the first ring;

the first ring comprises an outer surface, said outer surface facing the blocking surface and said outer surface comprising a shoulder forming a projection of which the diameter is less than the diameter of the first ring. The shoulder forming a projection contributes advantageously to the centring off the holding element with respect to the shaft of the turbine and to the blades. The shoulder is preferentially circular when the holding element is a ring;

the blocking surface comprises at least one abutment allowing for an adjustment of the blocking of the blades. The abutment advantageously makes it possible to adjust the axial blocking of the blades. The thickness of the abutment, i.e. its dimension according to the shaft of the turbine, is preferentially equal to the critical value before releasing. This critical value corresponds to the length of the blade root that is still necessarily in its cell beyond which the slightest jolt causes a falling of the blade and beyond which the clearance between blades is sufficient to be able to dismantle them one by one. Note that in general seal sleeves are inserted between two adjacent blades in order to limit the clearance between blades in order to contribute to maintaining them during the operation of the turbine. The seal sleeve is a wedge with a shock-absorbing thickness between each blade; and the dismantling opening is adapted to the passage of a mobile blade of a high pressure turbine of an aircraft. The dimensions of the dismantling opening are calculated in order to allow for the passage of such a blade, and more preferably a single blade.

The invention also relates to a system for dismantling at least one blade from a turbine, said turbine comprising a set of N blades, said system comprising a device for dismantling according to one of the previously described embodiments, a shaft of the turbine, with the first ring being attached to the shaft of the turbine in such a way that it is integral in rotation with the shaft of the turbine and the holding element being free in rotation with respect to the shaft of the turbine in the circular groove.

The invention also relates to a method for mounting a device for dismantling according to one of the previously described embodiments on a turbine shaft, said method comprising:

a step of attaching the first ring to a shaft of the turbine in such a way as to render integral in rotation the first ring of the shaft of the turbine;

a step of positioning the holding element on the shoulder of the first ring in such a way as to block the radial movements of the holding element;

a step of attaching the second ring to the first ring in such a way as to block the axial movements of the holding element.

In addition to the main characteristics that have just been mentioned in the preceding paragraph, the method according to the invention can have one or several of the following additional characteristics, considered individually or according to any technically permissible combinations:

the step of attaching the first ring is carried out on an apparent surface element of the shaft of the turbine, said shaft of the turbine being a trunnion; and the step of attaching the second ring is carried out by means of wing screws. The use of wing screws makes it possible to facilitate the use of the device. Indeed, it is not necessary to have tightening tools for assembly/disassembly. Such a type of screw can also be used for the attaching of the first ring to the shaft of the turbine.

The method can also comprise an additional step that consists in placing a rigid sleeve or cover in order to protect the shaft of the turbine and more particularly its trunnion if despite the device a blade were to fall on the trunnion which would require it to be replaced.

The invention also relates to a method for dismantling at least one turbine blade, said turbine comprising a set of blades, said method comprising:

a step for mounting a device for dismantling according to one of the previously described embodiments to a shaft of the turbine;

a step of partially extracting the set of blades by means of an access through the intermediary either of the dismantling opening or of the access opening; and a step of positioning the holding element according to a first angular position in such a way as to position the dismantling opening facing at least one blade to be dismantled.

An operator, in order to access the blades and partially extract them gradually, in ellipse from their respective cells can either be assisted by the dismantling opening, and in this case rotate the holding element so as to place facing the dismantling opening of each blade little by little; or use the access opening, or the plurality of access openings. For the dismantling of a blade, it is necessary to place the dismantling opening facing this blade in order to be able to pass it through; otherwise it is blocked by the blocking surface.

In addition to the main characteristics that have just been mentioned in the preceding paragraph, the method according to the invention can have the following additional characteristic: the step of partially extracting is carried out by a plurality of successive axial displacements of each one of the blades of the set of blades in such a way as to position said blades in abutment against the blocking surface. The partial extraction is carried out blade by blade by rotating along the entire turbine and by repeating this operation until the blade dimension, and more particularly blade root dimension, outside of the corresponding cell is sufficient so that the clearance between blades allows for the dismantling of a blade. In this case, the blades are in abutment against the blocking surface.

BRIEF DESCRIPTION OF THE FIGURES

Other characteristics and advantages of the invention shall appear when reading the following description, in reference to the annexed figures, which show.

For increased clarity, identical or similar elements are marked with identical reference signs in all of the figures.

DETAILED DESCRIPTION OF AN EMBODIMENT

Figure 1:
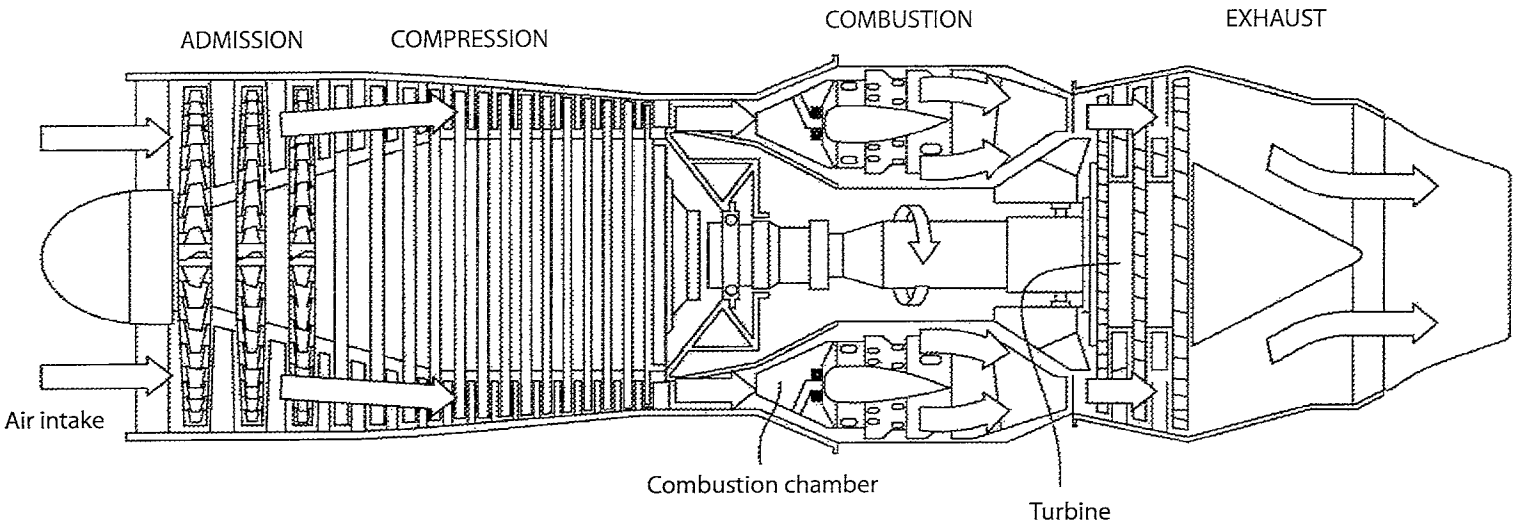
FIG. 1, a cross-section view of a turbine engine.
Figure 2:
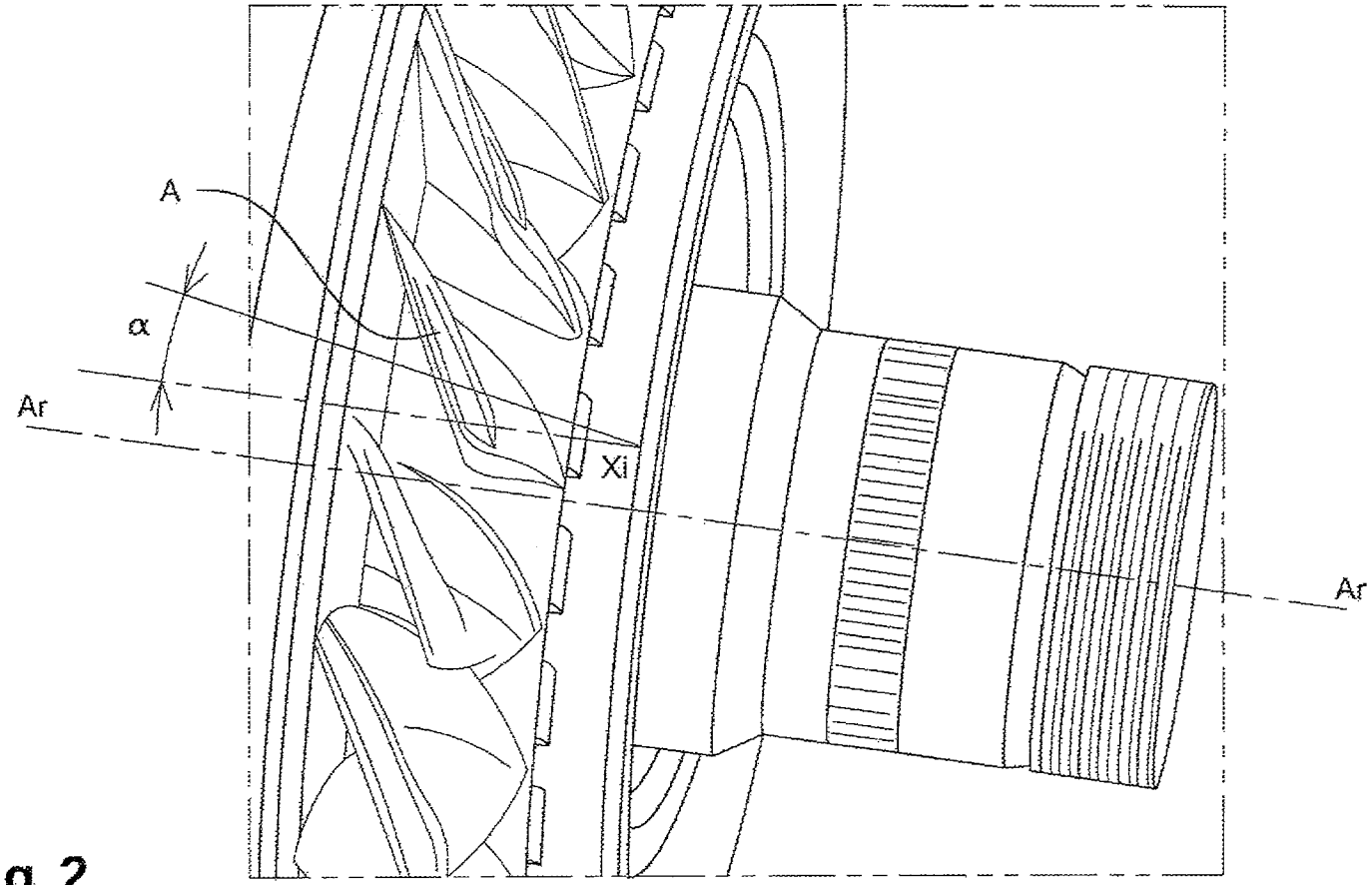
FIG. 2.

FIG. 1 shows a cross-section view of an aircraft engine.

Figure 3:
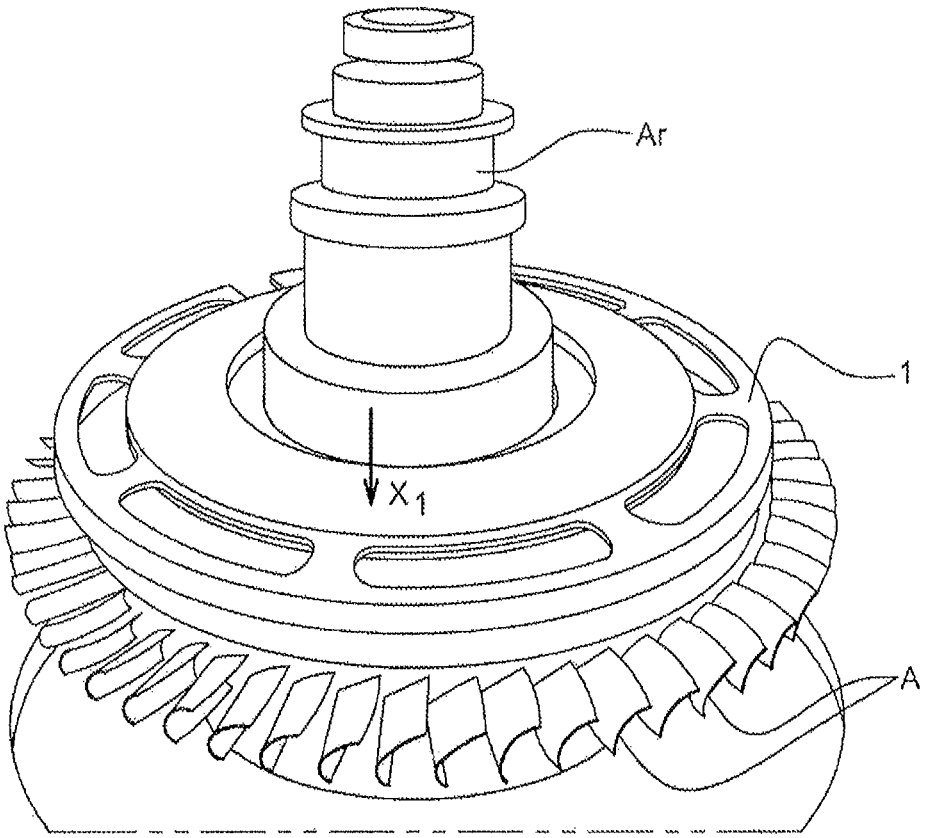
FIG. 3, a system for dismantling according to an embodiment of the invention, with the turbine being vertical.
Figure 4:
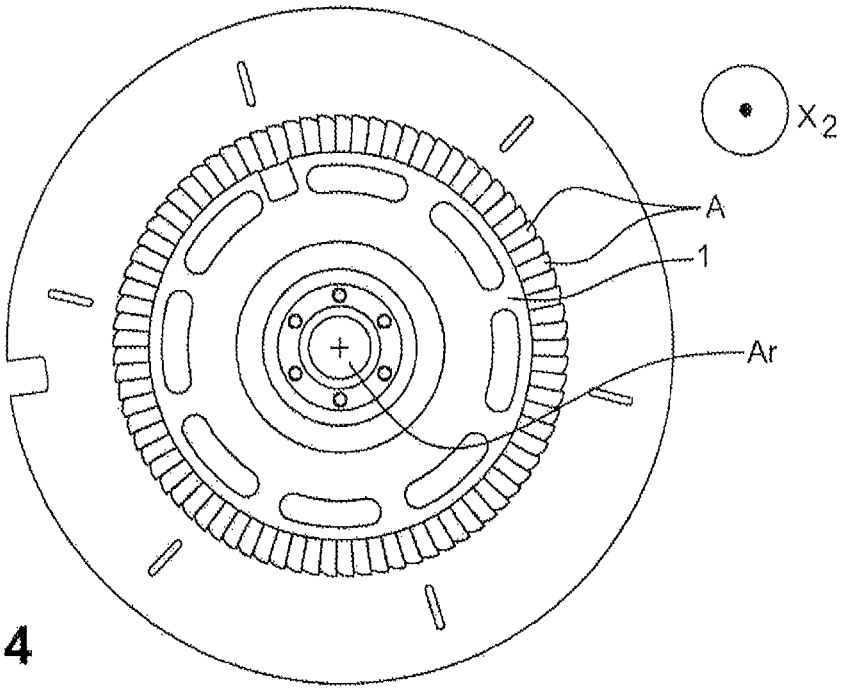
FIG. 4, the system for dismantling of FIG. 1, with the turbine being horizontal.

FIGS. 3 and 4 show a system for dismantling a blade A from a turbine, with the turbine comprising a set of blades A. The system for dismantling comprises a device for dismantling 1 and a turbine shaft Ar, here a trunnion.

FIG. 3 shows the system for dismantling in a vertical configuration of the turbine. This type of configuration is generally adopted for the installation of blades. As the blades are dismantled axially in their respective cells (cells that are not visible in the photo) according to the axis X1, it is visible only in this so-called vertical configuration, no risk of falling in the event of a jolt, impact is to be feared. Recall that the blades are installed (and dismantled) gradually, one after the other, elliptically millimetre by millimetre. In the vertical configuration, a blade of which the root is inserted by only one or two millimetres into its cell therefore does not risk falling.

FIG. 4 shows the system for dismantling of FIG. 1 in a horizontal configuration of the turbine. This configuration is generally used for an in-situ dismantling of blades. In this configuration, a blade of which the root is inserted by only one or two millimetres into its cell, just before the dismantling (which is the complete extraction of the blade from its cell according to the axis X2) risks falling without the device for dismantling 1 of which the operation shall be explained in more detail in reference to the following figures.

In the embodiments described in reference to the following figures, namely FIGS. 5A to 7B, the holding element is a ring.

Figure 5A:
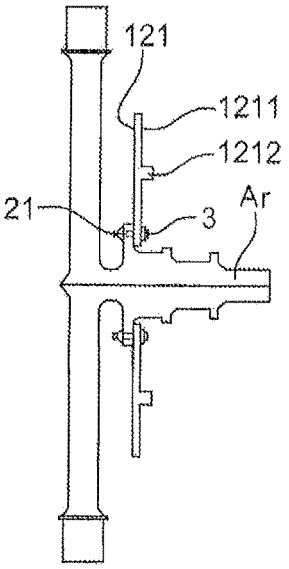
FIG. 5A, a side view of a turbine shaft and of a first ring made integral with the turbine shaft according to an embodiment of the invention.

FIG. 5A shows a first ring 121 attached to the shaft Ar of the turbine and as such made integral in rotation with the shaft Ar of the turbine. It is attached by means of a system 3 with screws and nuts to the shaft of the turbine Ar and more particularly to an apparent surface element 21 of the shaft Ar. The first ring 121 comprises a shoulder 1212 on the outer surface 1211 of the first ring 121.

Figure 5B:
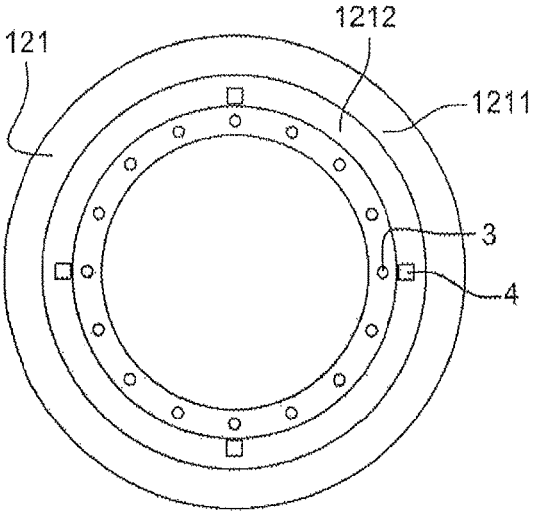
FIG. 5B, a front view of a first ring according to an embodiment of the invention.

FIG. 5B shows the first ring 121. It comprises passage holes 3 of the screw and nut system for the attaching of the first ring to the turbine shaft. Passage holes 4 of a system for attaching a second ring to the first ring can also be seen. The first ring comprises a shoulder 1212 forming a projection on the outer surface 1211 of the first ring. The outer surface 1211 is the surface that will be facing the blocking surface of the holding element once the latter is positioned in relation to first ring 121 and shall be described in reference to the following figures.

The shoulder 1212 is circular and its diameter is less than the diameter of the first ring. It has for function to allow for the positioning of the holding element and its centring.

Figure 6A:
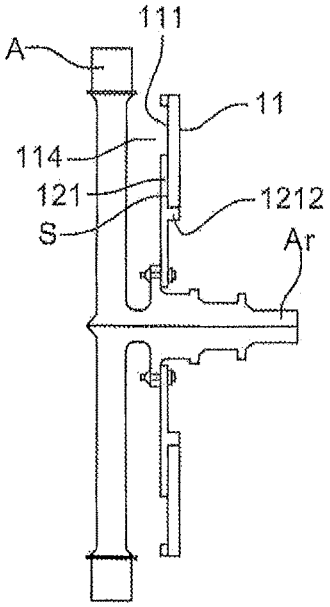
FIG. 6A, a side view of a turbine shaft, of a first ring made integral with the turbine shaft and of a holding element positioned on the first ring according to an embodiment of the invention.
Figure 6B:
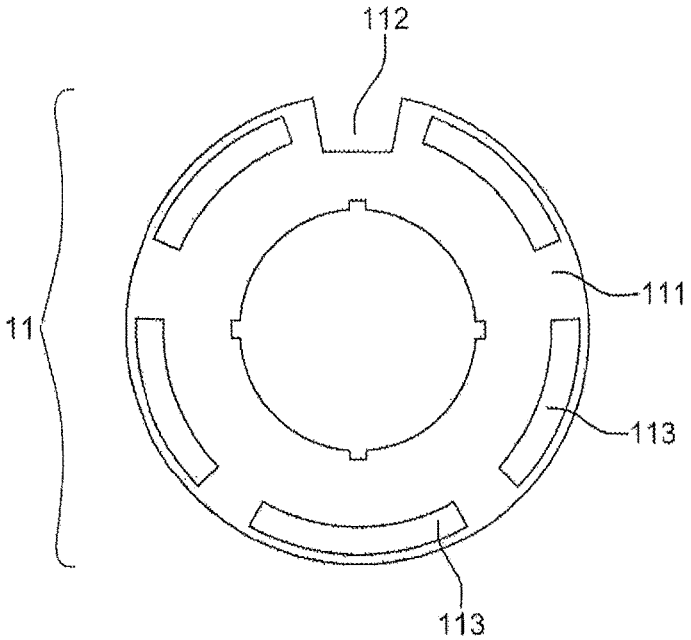
FIG. 6B, a front view of a holding element according to an embodiment of the invention.

FIG. 6A shows a holding element 11 positioned on the shoulder 1212 of the first ring 121, with the first ring being attached to the shaft Ar of the turbine. Positioned as such, the radial movements of the holding element 11 are blocked. Furthermore the axial movements towards the engine of the holding element 11 are blocked by the surface S of the first ring against which it is bearing.

The holding element comprises a blocking surface 111 which has for function to block the blades A in axial translation according to their axis of insertion in their respective cells in the direction of their dismantling, i.e. of their extraction from the cells. This axis is inclined with respect to the shaft of the turbine Ar, which is the axis of rotation of the engine. This inclination has for function to allow for the maintaining of the blades during the rotation at high speed of the turbine.

FIG. 68 shows the holding element 11. The blocking surface 111 is constituted by all of the holding element except the dismantling opening 112, which is a notch in this embodiment. The dimensions of the dismantling opening 112, through which is dismantled, i.e. completed extracted, the blade to be dismantled, are according to the geometry of the blade to be dismantled. The dismantling opening 112 is here at the periphery of the holding element 11, as such the dismantling opening 112 is also open outwards of the periphery of the holding element 11 and has this shape of a notch and can as such allow only the root of the blade to pass.

The holding element 11 of FIG. 68 comprises five access openings 113. These access openings 113 allow an operator to access, for example by means of his thumb, a zone of the space 114 defined facing the blocking surface (refer to FIG. 6A) in such a way as to catch the root of the blade in order to partially extract the blade. This partial extraction can also be executed by means of the dismantling opening 112, but in this case, the holding element must be rotated each time in order to place the dismantling opening 112 facing each blade, one after the other.

Figure 7A:
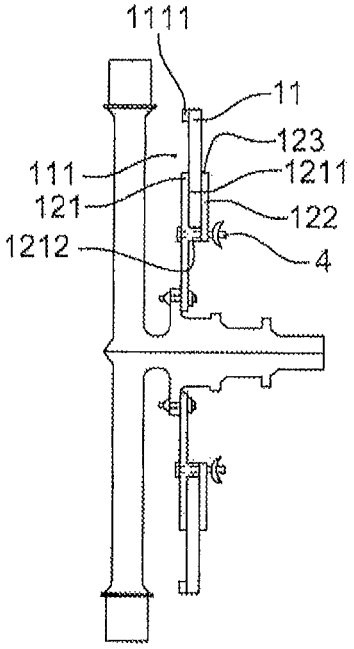
FIG. 7A, a side view of a system for dismantling according to an embodiment of the invention.

FIG. 7A shows the system for dismantling, once a second ring 122 is attached to the first ring 121 by means of wing screws 4, chosen for their tightening/loosening facility. The superposition of the first ring 121 and of the second ring 122 forms a circular groove 123 for the maintaining and the driving in rotation of the holding element 11 with respect to the shaft of the turbine Ar. The circular groove is formed by the shoulder 1212 of the first ring, the outer surface 1211 of the first ring facing the blocking surface 111 of the holding element and the second ring 122.

The holding element 11 comprises an abutment 1111 on the blocking surface 111. This abutment makes it possible to adjust the axial holding of the blades and the dimensioning of this abutment is according to the distance that the blades must be partially extracted from their cells before being able to be dismantled by the dismantling opening 112.

The first ring/second ring unit forms the attachment means 12 of the holding element 11 to the shaft Ar of the turbine. Thanks to the circular groove formed by the superposition of the first and second rings wherein the holding element is located, a pivot connection is formed between the holding element and the shaft Ar of the turbine.

Figure 7B:
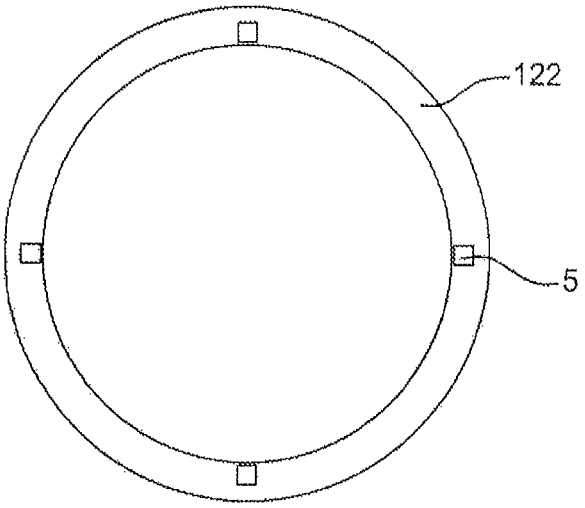
FIG. 7B, a front view of a second ring according to an embodiment of the invention.

FIG. 7B shows the second ring 122 comprising passage holes 5 for the wing screws 4 allowing for the attaching of the second ring to the first ring.

For the dismantling of a blade, it is necessary in a first step, once the device for dismantling is installed, to partially extract each one of the blades A:

either with the help of the access openings of the holding element;

or with the help of the dismantling opening of the holding element, and in this case, rotating the holding element so as to place the dismantling opening facing each time the blade to be manipulated.

Once the dismantling of the blades is imminent, i.e. when they have arrived in abutment against the blocking surface, which prevents them from falling in the event of a jolt or impact, the operator pivots the holding element about the shaft of the turbine in order to bring the dismantling opening facing each blade to be dismantled so as to completely extract it from its cell by passing it through the dismantling opening as it is no longer blocked by the blocking surface of the holding element. With the holding element having several angular positions according to the blade to be dismantled. The blocking surface provides the maintaining of the non-dismantled blades in safety.

The invention is not limited to the previously described embodiments in reference to the figures and alternatives could be considered without leaving the scope of the invention.

The invention claimed is:

1. A device for dismantling at least one blade from a turbine, said turbine comprising a set of blades, each of said blades of the set of blades being retained in a cell of a turbine cell assembly, said device comprising:

a holding element that is a ring, and an attachment system configured to attach the holding element to a shaft of the turbine, the attachment system producing a pivot connection between the holding element and the shaft of the turbine, wherein the holding element comprises a blocking surface and a dismantling opening, and wherein an angular position of the holding element may be altered relative to the shaft to present either the dismantling opening or the blocking surface to least one blade of the turbine so as to perform a first function of partial extraction of said at least one blade when said at least one blade faces the dismantling opening and a second function of blocking another blade, of the set of blades, facing the blocking surface, said holding element comprising at least one access opening formed in the blocking surface that allows an operator to access a zone of the space defined facing the blocking surface.

2. The dismantling device as claimed in claim 1, wherein the dismantling opening is at a periphery of the holding element.

3. The dismantling device as claimed in claim 1, wherein the attachment system comprises:

a first ring;

a second ring; and a superposition of the first and second rings forming a circular groove for maintaining the holding element, wherein the holding element positioned in said groove is drivable in rotation with respect to the shaft of the turbine.

4. The dismantling device as claimed in claim 3, wherein the first ring comprises an outer surface, said outer surface facing the blocking surface and said outer surface comprising a shoulder forming a projection of which a diameter is less than a diameter of the first ring.

5. The dismantling device as claimed in claim 1, wherein the blocking surface comprises at least one abutment allowing for an adjustment of the blocking of the set of blades.

6. The dismantling device as claimed in claim 1, wherein the dismantling opening is adapted to the passage of a mobile blade of a high pressure turbine of an aircraft.

7. A system for dismantling at least one blade from a turbine, said turbine comprising a set of N blades, said system comprising:

a device for dismantling as claimed in claim 3;

a turbine shaft;

wherein the first ring is attached to the turbine shaft in such a way that the first ring is integral in rotation with the turbine shaft and the holding element is free in rotation with respect to the turbine shaft in the circular groove.

* * * * *